United States Patent [19]

Wycech

[11] Patent Number: 4,559,984

[45] Date of Patent: Dec. 24, 1985

[54] FUNNEL

[76] Inventor: Joseph Wycech, 28050 Groesbeck, Roseville, Mich. 48066

[21] Appl. No.: 615,818

[22] Filed: May 31, 1984

[51] Int. Cl.[4] ..... B65B 3/04

[52] U.S. Cl. ..... 141/340; 285/425

[58] Field of Search ..... 141/331–345; 285/425

[56] References Cited

U.S. PATENT DOCUMENTS

| | | | |
|---|---|---|---|
| 998,352 | 7/1911 | Kublin | 141/340 |
| 1,396,606 | 11/1921 | Vincent | 141/340 |
| 1,868,389 | 7/1932 | Howard | 141/340 |
| 2,168,395 | 8/1939 | Damkroger | 141/340 |
| 2,517,759 | 8/1950 | Bentzen | 141/340 |
| 2,811,181 | 10/1957 | Correll | 141/340 |
| 3,899,012 | 8/1975 | Sather | 141/340 |
| 4,112,984 | 9/1978 | Guglia et al. | 141/340 |
| 4,338,983 | 7/1982 | Hatcher | 141/340 |

*Primary Examiner*—Houston S. Bell, Jr.

*Attorney, Agent, or Firm*—Cullen, Sloman, Cantor, Grauer, Scott & Rutherford

[57] ABSTRACT

A funnel for an enclosure having an aperture which comprises a funnel body terminating in an elongated exteriorly threaded spout adapted for projection into the aperture. A rotatable nut having a depending tapered conical shoulder is threaded over the spout for longitudinal adjustment thereon and for selective sealing registry with the enclosure and its aperture. A transverse anchor pin upon the spout is positioned within and operatively engages the enclosure when the nut is advanced into operative retaining registry therewith.

10 Claims, 6 Drawing Figures

FUNNEL

BACKGROUND OF THE INVENTION

The present invention relates to funnels and more particularly to a funnel for an enclosure having an aperture to receive a funnel spout and with some means to rigidly supporting the funnel in a substantially upright position upon the enclosure.

Heretofore conventional funnels normally require the use of one hand for holding the funnel and the use of the other hand for pouring liquid into the funnel.

Since enclosure apertures are of varying sizes, there is a need for a funnel or funnel adapter which will conform to a particular diameter of aperture for an enclosure and is provided with some means which will rigidly affix and seal the funnel to the enclosure so as to be self-supporting.

THE PRIOR ART

Efforts have been made to provide a mechanism by which the funnel spout is adapted to the particular enclosure aperture and is provided with some means to anchor the funnel in position using an adapter or providing a replacement cap which was apertured to receive a funnel neck or some other form of support mechanism for the purpose of securing the funnel to the enclosure relative to its aperture.

The difficulty with efforts in the past of providing such a funnel is that container and enclosure apertures are of varying diameter. It is difficult to find a funnel assembly which will cooperatively and adjustably seal over and into such aperture while at the same time will be maintained in an upright rigid self-supported position for use.

SUMMARY OF THE INVENTION

A feature of the present invention is to provide a funnel for an enclosure having an aperture wherein the funnel spout is projected into the enclosure aperture and is exteriorly threaded to receive a self sealing rotatable nut with a depending conical shoulder for cooperative sealing registry with the enclosure at its aperture and wherein an anchor member is mounted on and projects from the spout upon the interior of the enclosure. With such a construction upon manual rotative adjustment of the nut against the enclosure, the anchor member is drawn up into snug securing engagement with the enclosure so that the funnel is rigidly and self-supported when mounted upon the enclosure.

A further feature is to provide a funnel including a funnel body and spout having an exterior threaded thereon which is molded of a plastic material and upon which is mounted a manually rotatable nut having a depending, tapered, conical shoulder adapted for sealing registry with the enclosure at its aperture together with an anchoring lug mounted upon and projecting from the spout and positioned upon the interior of the enclosure adapted for operative retaining engagement therewith when the rotatable nut is threaded snugly down onto the enclosure.

Still another feature is to provide a funnel having a funnel body and spout and exterior threads on the spout all molded of a plastic material and with a rotatable nut having a depending tapered conical sealing shoulder made from a plastic material.

Another feature is to provide an improved funnel wherein its depending threaded spout is adapted to project within apertures of varying dimensions and wherein the manually rotatable nut is threaded over the spout and includes a tapered conical shoulder adapted for selective longitudinal registry with the closure and its aperture for providing a seal thereover, regardless of the diameter of the aperture. With such a construction sufficient manual rotation of the nut over and along the spout lengthwise thereof an anchoring lug or anchor pin is drawn up to the enclosure in a compressive retaining arrangement. Upon sufficient tightening of the nut the funnel is rigidly mounted and sealed upon an enclosure in a substantially upright self-supportive position.

It is another feature to provide an improved funnel having a cylindrical portion adapted to receive an apertured inverted oil container, for illustration, with the cylindrical portion terminating in a frusto-conical section which terminates in an exteriorly threaded spout. Anchoring means are provided upon the spout for securing the funnel in a rigid position with respect to the enclosure and its aperture, and which is self-supporting after assembly.

These and other objects and features will be seen from the following specification and claims in conjunction with the appended drawings.

THE DRAWINGS

It will be understood that the above drawings illustrate merely a preferred embodiment of the invention and that other embodiments are contemplated within the scope of the claims hereafter set forth.

DETAILED DESCRIPTION OF AN EMBODIMENT OF THE INVENTION

Figure 1:
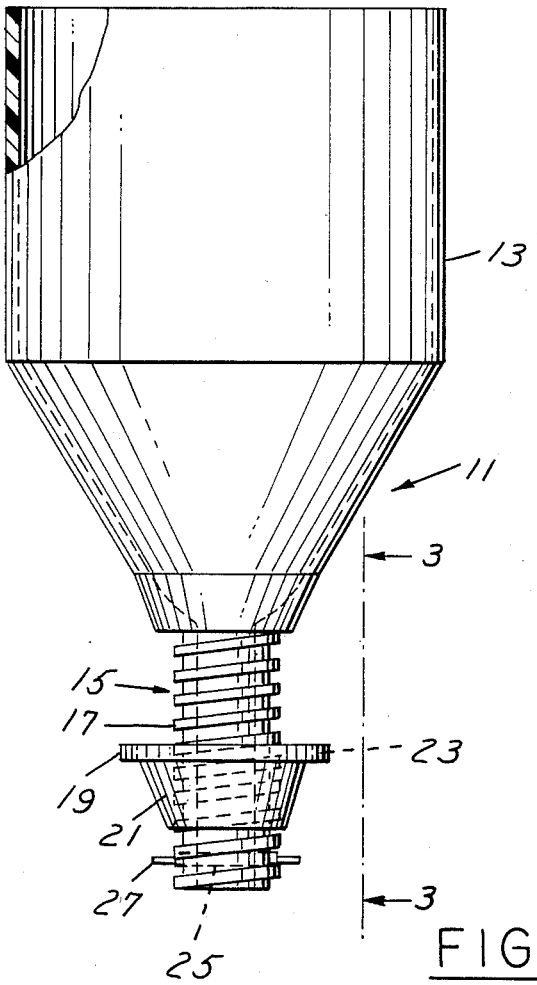
FIG. 1 is a partly broken away and sectioned side elevational view of the present funnel.
Figure 2:
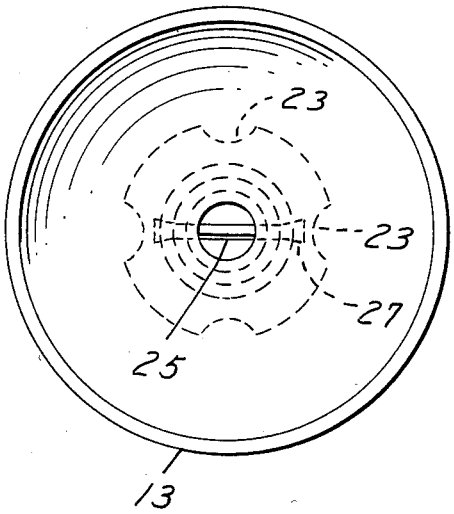
FIG. 2 is a plan view thereof.
Figure 3:
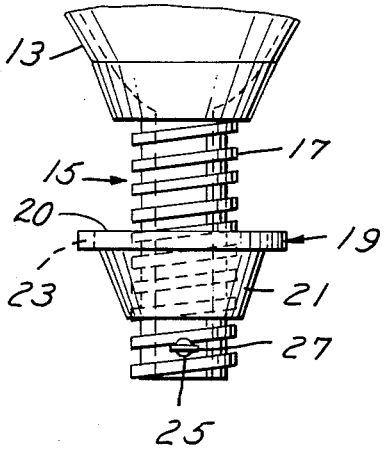
FIG. 3 is a fragmentary side elevational view taken in the direction of arrows 3—3 of FIG. 1.

Referring to the drawings, the present funnel with self-sealing tapered nut, shown in FIG. 1, includes a funnel body 13, preferably molded from a plastic material, and having a frusto-conical section from which depends the elongated spout or neck 15. The frusto-conical section, the body and the spout are of a unit plastic construction. The spout 15 has a longitudinal axis and a free end adapted to project into an aperture of an enclosure.

Figure 4:
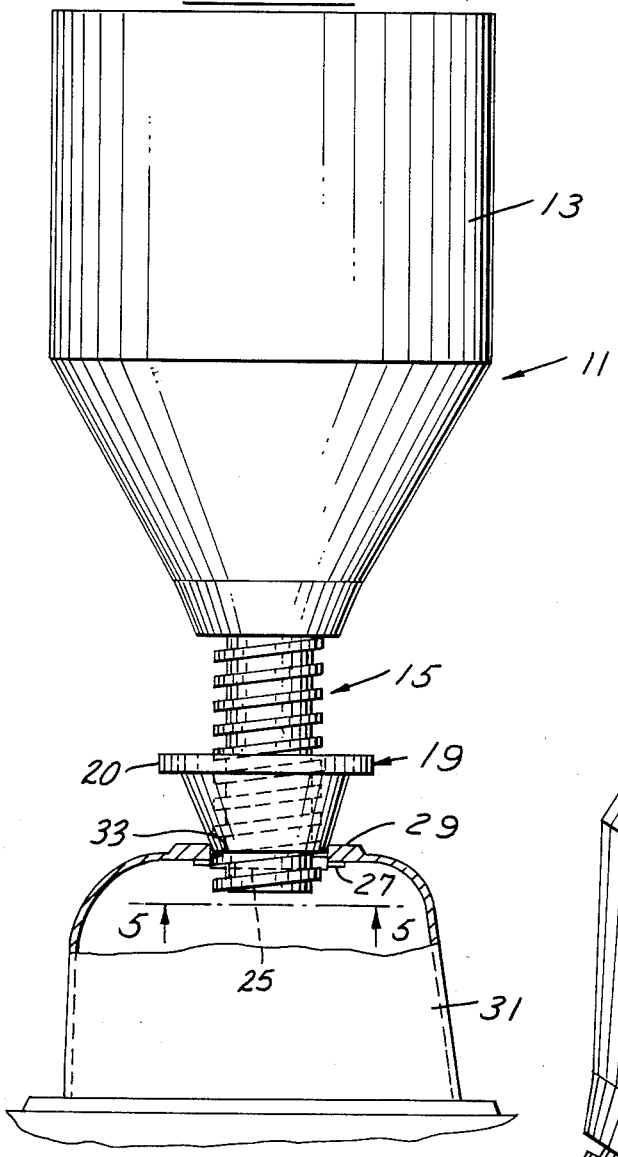
FIG. 4 is a similar view of a funnel of FIG. 1 assembled and anchored upon an enclosure, such as an engine valve cover, for illustration.
Figure 6:
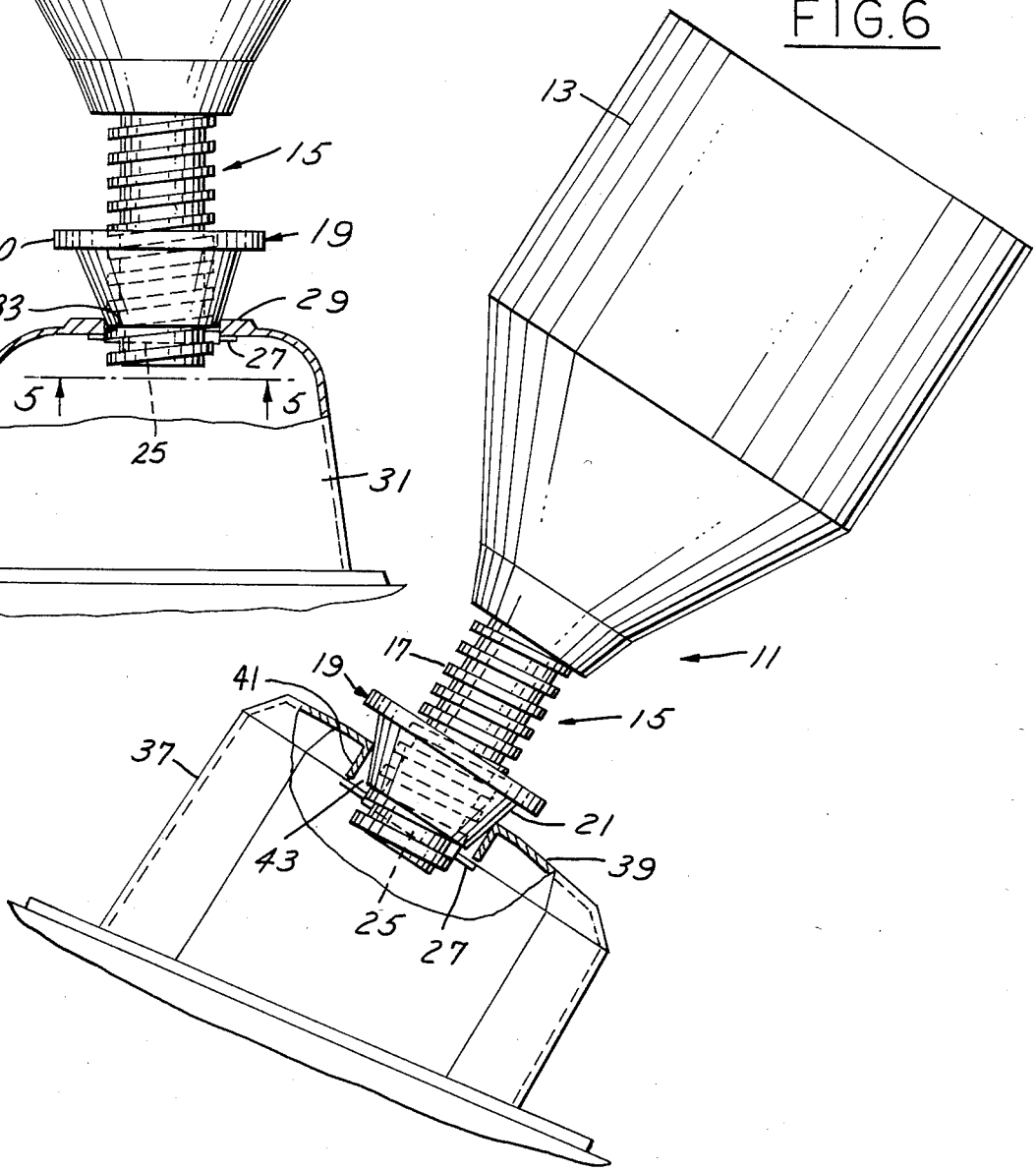
FIG. 6 is a side elevational view similar to FIG. 4 showing the mounting and anchoring of the present funnel upon an enclosure having an inwardly directed passage defining an aperture.

A continuous spiral thread 17 is molded upon and along the entire length of the spout 15. A self-sealing nut 19 is made from a plastic material, such as polystyrene, is interiorly threaded and includes an annular flange 20 having a depending tapered conical shoulder 21 adapted for sealing registry with apertures of different diameters, as shown in FIGS. 4 and 6. The nut 19 has a leading end and a trailing end, with the flange 20 located at the trailing end of the nut.

Formed around the periphery of the annular flange 20 of the self-sealing nut 19 are a series of spaced grip indentations 23 to facilitate manual rotation thereof. Transverse anchor pin or locking lug pin 25 projects through a lower end portion or free end of the spout 15 and outwardly thereof and has a pair of flattened ends 27. The lug pin is located opposite the leading end of the nut 19 for preventing the nut 19 from being separated from the spout 15.

In assembly of the funnel 11 with respect to the aperture 33 in the cover plate 29 of the enclosure 31, which may be an engine valve cover for illustration, the threaded spout 15–17 is projected down into the aperture 33 and with the lug pin or anchor pin 25 positioned upon the interior of the enclosure.

In operation, after assembly of the spout and anchor pin 25 down through aperture 33 and into the enclosure, 31, the self-seating nut 19 with its tapered conical shoulder 21 is manually rotated into engagement and registry with the cover plate 29 of the enclosure. Rotation of the nut continues until the lug pin 25 has been brought snugly up against the undersurface of cover plate 29 as in FIG. 4. This provides a means by which the self-sealing nut 19 is sealed with respect to the cover plate 29 at its aperture and at the same time, the entire funnel assembly is rigidly supported in a self-supporting position with respect to the enclosure 31.

Figure 5:
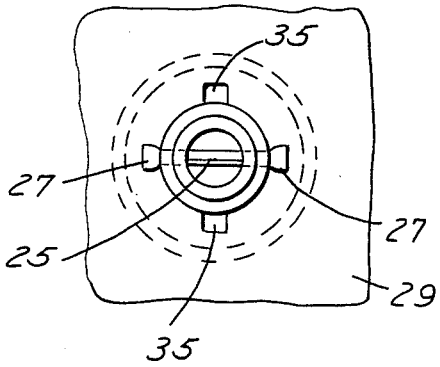
FIG. 5 is a fragmentary bottom plan view taken in the direction of arrows 5—5 of FIG. 4.

While under some conditions, the anchor pin 25 at its ends may be of such dimension as to be projectable through the aperture 33 when the nut 19 is retracted from the position shown in FIG. 4, there is shown in FIG. 5 a pair of oppositely directed opposed cover plate clearance slots 35. Therefore upon assembly of the funnel with the spout 15 projected down through the aperture 33, the anchor pin 25 moves through the slots 35. Upon a limited rotation of the funnel, a few degrees such as to the 90 degree position shown in FIG. 5, the locking or anchor pin 25 will be retained upon the interior of the cover plate 29.

On successive manual rotation of the self-sealing nut 19 and its depending tapered conical shoulder 21 into registry with the enclosure 31, the anchor pin 25 is drawn snugly against the interior surface of the cover plate 29 and with the conical shoulder 21 is in snug sealing engagement with the enclosure.

In FIG. 6, there is shown a modified engine valve cover 37 or other enclosure having a cover plate 39 and an inturned annular flange 41 defining an oversized aperture 43 into which the spout 15 is loosely projected.

In order to accommodate apertures 43 of different sizes, all that is necessary is there be sufficient manual rotation of the self-sealing nut 19 so the shoulder 21 is partly projected down into the inturned channel 41 and at the same time the anchor pin 25–27 is drawn up snugly against the inner surface of channel 41.

The funnel assembly shown in FIG. 6 is adapted to fit apertures of an enclosure, such as an engine valve cover for illustration, wherein such aperture is variable between the minimum and maximum diameters of the tapered conical nut shoulder 21.

The flattened ends 27 of the anchor pin 25 are adapted to cooperatively register with undersurface portions of the cover plate 29 or inturned channel 41, FIGS. 4 and 6 of the correponding enclosures 31 or 37.

Having described my invention, reference should now be had to the following claims:

I claim:

1. A funnel for an enclosure having an aperture comprising a funnel body terminating in an elongated spout provided with a longitudinal axis and having a free end adapted for projection into the aperture;

exterior threads located upon and extending along the entire length of said spout from said funnel body to said free end thereof;

a rotatable nut threaded over said spout for longitudinal adjustment thereon between said funnel body and said free end thereof;

said nut having a leading end and a trailing end;

a laterally extending annular flange provided on the trailing end of said nut to facilitate grasping and rotation of said nut upon said spout;

a tapered conical shoulder depending from said flange and integral with said nut adapted for selective sealing and cooperative registry with the enclosure at its aperture;

a single lug pin carried by said spout and arranged perpendicular to and intersecting the longitudinal axis of said spout;

said lug pin having a pair of flattened ends located on the free end of said spout opposite the leading end of said nut for preventing the nut from being separated from said spout;

said lug pin also extending transversely outward of said spout positioned within and operatively engaging said enclosure of manual rotation of said nut into operative retaining registry therewith;

said enclosure being compressively engaged between the leading end of said nut and the flattened ends of said lug pin; and said funnel being rigidly and self-supported when mounted upon the enclosure.

2. In the funnel of claim 1, said funnel body, spout and nut being molded from a plastic material for improved sealing of said nut with the enclosure.

3. In the funnel of claim 1, said conical shoulder being selectively projected and sealed down into the aperture depending upon the aperture diameter.

4. In the funnel of claim 1, the minimum and maximum diameters of said shoulder adapting said nut to a range of aperture diameters.

5. In the funnel of claim 1, said flange having a series of spaced indentations to further facilitate grasping and rotation of said nut upon said spout.

6. In the funnel of claim 1, said enclosure adjacent its aperture having a pair of opposed radial pin clearance slots for projecting said pin through the aperture down into the enclosure, said spout being rotatable taking said lug pin out of registry with said clearance slots.

7. In the funnel of claim 1, said nut upon sufficient rotation being self sealing relative to the enclosure.

8. In the funnel of claim 1, said nut on sufficient rotation in one direction drawing up said lug pin relative to the enclosure for locking said funnel upon the enclosure.

9. In the funnel of claim 1, said enclosure including an apertured mount plate receiving said spout and lug pin;

said lug pin being adapted to operatively engage said mount plate.

10. In the funnel of claim 1, said enclosure including a mount plate with an inwardly directed channel receiving said spout and lug pin;

said lug pin adapted to operatively engage said channel.

* * * * *